US005513694A

United States Patent [19]

Cameron

[11] Patent Number: 5,513,694

[45] Date of Patent: May 7, 1996

[54] ANODIC PROTECTION METHOD AND SYSTEM

[76] Inventor: Gordon M. Cameron, 4 Wellesbourne Crescent, Willowdale, Ontario, Canada, M2H 1Y7

[21] Appl. No.: 388,799

[22] Filed: Feb. 15, 1995

[30] Foreign Application Priority Data

Feb. 15, 1994 [CA] Canada ..... 2115719

[51] Int. Cl.[6] ..... F28F 19/00

[52] U.S. Cl. ..... 165/1; 165/134.1; 205/735; 205/736; 205/740; 204/196

[58] Field of Search ..... 165/134.1, 1; 204/147, 204/196

[56] References Cited

U.S. PATENT DOCUMENTS 4,080,272 3/1978 Ferry et al. ..... 204/147
4,437,957 3/1984 Freeman ..... 204/147
4,588,022 5/1986 Sanz ..... 165/1
4,689,127 8/1987 McAlister ..... 204/147

FOREIGN PATENT DOCUMENTS 18124 10/1980 European Pat. Off. .

*Primary Examiner*—Allen J. Flanigan
*Attorney, Agent, or Firm*—Cushman, Darby & Cushman

[57] ABSTRACT

A heat exchanger and process for use with a corrosive fluid, such as sulphuric acid, having an anodic protection system for protecting the acid-contacted surfaces wherein the anodic protection system has a plurality of elongated cathodes of such cross sectional area and length as to operably maintain voltage losses due to current flow along the cathodes at values less than the allowable passive voltage ranges at the acid-contacted surfaces.

19 Claims, 7 Drawing Sheets

ANODIC PROTECTION METHOD AND SYSTEM

FIELD OF THE INVENTION

This invention relates to an anodic protection method and system for providing improved acid corrosion resistance to heat exchangers, particularly heat exchangers for sulphuric acid duty.

BACKGROUND OF THE INVENTION

In the manufacture of sulphuric acid by the contact process, large quantities of heat are generated and removed partly by cooling recirculating streams of concentrated acid ranging in strength from 93 to 99.5% sulphuric acid. In modern sulphuric acid plants, shell and tube heat exchangers are commonly used which are fabricated of stainless steel and anodically protected on the acid side to minimize corrosive attack on the stainless steel. In such coolers, the acid to be cooled is passed through the shell space and cooling fluid, typically water, is passed through the tubes. The cooling water is the dirtier of the two fluids and in most duties, cleaning is needed only on the water side. Other reasons for the acid circulating in the shell include easier anodic protection and better overall heat transfer coefficients, which allow of smaller acid coolers and, hence, lower costs.

Anodic protection is a technique applicable to metals, such as tantalum, aluminium, carbon steel and the stainless steels, which normally form a stable oxide film on the surface of the metal. In many environments, such films may be either unstable or not formed due to the nature of the liquid in contact with the metal. Anodic protection causes a current to flow across the metal surface such that an oxidizing condition is created leading to formation of the oxide film which is relatively insulating and protects the surface against the liquid medium. Thus, anodic protection can be used for those duties in which metal without anodic protection would dissolve rapidly, as well as in conditions in which the protection decreases the corrosive attack by several orders of magnitude.

Anodic protection was initially introduced in the 1950's and 1960's to protect carbon steel in an environment in which the metal would have dissolved in days or even hours without anodic protection against hot acid. Subsequently, the technique was used in the shell space of shell and tube exchangers to protect exposed stainless steel against corrosion by hot, concentrated sulphuric acid. The exchangers were designed, however, such that a significant cooler life was possible without anodic protection in the event that a short outage of the anodic protection system would not have catastrophic consequences.

To protect the shell space of a shell and tube heat exchanger, two types of cathodes are normally used. These are longitudinal cathodes arranged in the shell parallel to the tubes, and pin cathodes inserted in the acid inlet and outlet nozzles. Reference electrodes are needed to ensure that the appropriate degree of anodic protection is being supplied. In all cases, the cathodes must be insulated from the metal surface being protected and this is done by use of fluoropolymer sleeves or sheaths in the case of longitudinal cathodes and pin cathodes or glass in the case of the reference electrodes. Power requirements for anodic protection are quite small, for example, a large exchanger with 6000 square feet of heat transfer surface can be protected in most cases with a current flow of less than 20 amperes at a voltage of less than 1.5 volts, corresponding to less than 30 watts. Annual power consumption in such systems is therefore trivial in comparison to the capital cost of a cooler, which can range up to $500,000.

Longitudinal cathodes in such heat exchangers are normally made of proprietary alloys, such as Hastalloy B or C, and are arranged either in the bundle or in dome spaces on the exchanger if such spaces are available. The cathodes are inserted through an end of the exchanger and generally pass in a cathode tube through the water box and then through the tube sheet into the shell space to the opposite tube sheet. In some cases, the cathodes may pass through both tube sheets and both water boxes so that power can be fed to both ends of the cathode rod. Typically, the cathode diameter ranges from 1 cm to 1.5 cm.

To isolate the cathode electrically from the surface of the tubes, baffles, and shell being protected, the cathode is contained in an acid resistant sheath generally formed of a fluoropolymer, e.g. TEFLON® polytetrafluoroethylene. The sheath is, typically, perforated in the regions between and remote from baffles and solid near the baffles and tube sheets. In this way the possibility of current flow from the cathode direct to the exchanger metal is avoided. In practice, it has been found necessary to keep the cathode to metal gap at least 25 mm in size to avoid current short-circuiting. Similar sleeves are used in the seals on the ends of the cathode in the cathode tube where the cathode is extended to atmosphere with an air to acid seal, while around the cathode tube a water to air seal is provided.

Surfaces of, for example, stainless steel in hot concentrated acid in turbulent conditions are not automatically passive and power has to be applied to create the passive film. Initially, the surface will be partly passive and partly active with the active portion of the surface moving from one location to another at random. As current is applied, corrosion initially increases to form the anodic film. There is a maximum current needed which is referred to as the 'critical current'. Clearly, if the current available is small, the ability to modify a large surface will be small and the possibility exists that the current may actually add to corrosion and not protect the surface. The size of the critical current will depend on the size of the unit to be protected, the past history of the metal surface to be protected, the fluid with which it is in contact, and the temperature of the surface. A more dilute acid such as 93%, which is used for drying of gases, will have a higher critical current than 98.5% acid, which is used for absorption purposes. Similarly, hot acid will be associated with higher critical current than cold acid.

The anodic protection phenomenon is also not just simply a matter of creating an anodic surface on the metal by application of an appropriate voltage. Excessive voltage can cause significant damage to the surface by a phenomenon known as 'transpassive corrosion'. The oxide film on stainless steel depends on the voltage applied and as the voltage rises the relatively insulating and non-corrodable film changes and becomes porous, allowing metal to dissolve and be carried away into the acid. Transpassive corrosion by this mechanism can cause significant damage to the metal surface and such corrosion has been observed where a metal surface was exposed very close to a cathode supplying the protecting current. The voltage levels at which transpassive corrosion can occur are dependent on the same factors which affect the passive film.

The region of applied potential in which the passive film exists is known as the 'passive' zone and varies in width with acid strength and temperature and narrows as the acid temperature rises or the acid concentration drops. Similarly, the boundary zone for transpassive corrosion moves lower at the same time, reducing the zone of safe protection of the heat exchanger at higher temperatures or lower concentrations.

Distribution of an appropriate protecting current throughout the shell space of an exchanger, which space may be as long as 13 meters with a diameter as wide as 1.3 m cannot be taken for granted. Often the protective voltage and current may be adequate at one end of the exchanger but not at the other. In such cases, trim cathodes are now used which consist of short sections of rod inserted at 90 degrees to the acid flow in the inlet or outlet acid nozzles of the exchanger. These cathodes have fluoropolymer sleeves to isolate them from the surface being protected and the extent of exposure of cathode surface or the resistance of the lines feeding current to the trim cathode surface can be varied to suit the circumstances. The power input from pin cathodes modifies the potential available in the region in which it is installed and can cause an appropriate reading on the reference electrode located in the same zone.

Present practice in such anodically protected coolers is to use longitudinal cathodes extending essentially the length of the tube bundle with current feed from one end and to use pin cathodes to supply additional current to allow the reference electrode readings to be within the control parameters at both ends of the cooler. In some cases electrical resistances have also been used in series with the cathodes and some coolers have power supplied to both ends of the cathode rods, as described, for example, in U.S. Pat. No. 4,588,022 to Sanz, issued May 13, 1986. Cathodes have also been located either in the dome space or in the tube bundle, with a clearance space around the cathode to avoid transpassive attack on adjacent tubes.

There are a number of features of construction and operation of existing anodic protection systems which are less than ideal.

A typical exchanger may have as many as twenty or thirty baffles. The effect of a pin cathode on current flow is limited by the baffle to the inlet or outlet pass where the cathode and reference electrode are located. Additional protection provided by a pin cathode therefore has little effect in the next baffle opening and corrosion may occur there without alarming the reference electrode.

The fluoropolymer sheath around the cathode rod is known to deform over time with temperature. Where the sheaths pass through baffles it is possible for deformation to be such that the cathode rod and sheath cannot be withdrawn through the baffle for maintenance without significant force which can damage the exchanger and in some cases withdrawal has been impossible.

Reduction in the thickness of the cathode rod, which is gradually corroding, is usually from the hot end and can then limit severely the current entering the exchanger.

The resistance of the cathode rod can cause excessive voltages at one end of the rod without generating adequate protection at the opposite end of the exchanger. This problem is especially severe on start-up of a cooler when a large unpassivated surface exists.

The use of holes in the cathode sheath to allow current to flow from the cathode to the acid results in restriction in current flow, which allows significant voltage differences to develop which can cause other cathodic processes to occur with formation of insoluble sulphate or sulphur deposits. These deposits can plug the holes in the sheath and insulate it from the acid. The higher the current density leaving the cathode, the higher the voltage required and the greater the possibility of corrosion and the formation of undesirable deposits.

In existing designs there is a need to cope with significantly different temperatures and current requirements at opposite ends of the acid cooler while the same cathode arrangements are used.

Accordingly, there is, therefore, a need for an anodic protection system which provides improved corrosion resistance to a heat exchanger.

SUMMARY OF THE INVENTION

It is an object of the present invention to provide a cathode system which is able to handle high current flows while maintaining cathode voltage losses significantly less than the width of the anodically passive zone in the exchanger.

It is a further object to provide a cathode system in which normal cathode voltage losses due to current flow along the cathode are an order of magnitude less than the anodically passive zone width.

It is yet a further object to provide a cathode system in which the current density entering the acid is significantly reduced and in which the cathodes are located in dome spaces in the exchanger.

It is still yet a further object to provide a cathode system which is relatively insensitive to cathode metal loss.

It is another object to provide a system which does not rely on pin or trim cathodes for control or protection.

It is another object to provide a system in which cathodes are bare and easily inspected.

It is another object to provide a system in which cathodes can receive power through shell connections as well as from the ends.

It is another object to provide a cathode system in which cathode diameter and length can be adjusted to provide greater current carrying capacity for the portion of the cooler having the greatest current demand.

It is another object to provide a cathode system with improved cathode voltage control along the exchanger so corrosion resistance can be maximized.

It is another object to provide a cathode system which does not have to rely on full length cathode rods.

These and other objects and advantages of the invention will be readily seen from a reading of the specification as a whole.

Accordingly, in its broadest aspect the invention provides a heat exchanger for a corrosive fluid, said heat exchanger having an elongated shell, said shell having dome spaces, a first end shell inner surface defining a first end shell space and a second end shell inner surface defining a second end shell, a plurality of elongated tubes extending longitudinally within said shell space, said corrosive fluid being located between said shell and the exterior surfaces of said tubes and a heat exchange fluid flowing within said tubes to exchange heat with said corrosive fluid, baffle means within said shell to direct the flow of said corrosive fluid in a tortuous path within said shell; an anodic protection system for protecting the exterior surfaces of said tubes and other exposed metal surfaces such as the surfaces of baffles, shell, and tube sheets, said anodic protection system comprising: power supply means for supplying a positive potential, means for connecting said positive potential to said shell, elongated cathode means extending longitudinally in said shell and insulated from said shell and tubes, said cathode means being of a material having substantial electrical resistance, connection means to said cathode means, wherein the improvement comprises said cathode means having a first, elongated cathode means associated with said first end shell space and a distinct second, elongated cathode means associated with said second end shell space, said first and said second cathode means being of such cross-sectional area and length as to operably maintain voltage losses due to current flow along said first and said second cathode means at values less than the allowable passive voltage ranges at each of said inner surfaces of said first and said second shell spaces; wherein said cathode means is adapted to provide in each zone a similar and low current density where the current flows from said cathode means into said acid.

In one aspect of the invention, longitudinal cathodes having outer surfaces of Hastalloy B or equivalent material and possibly having cores of more highly conductive materials, such as carbon steel or copper, are inserted from each of the two ends of the exchanger into dome spaces above and/or below the tube bundle. Current is fed from the power supply in parallel to these cathodes. The cathodes pass through insulated seals and insulating bushings on the baffles, with the insulating bushings providing an isolation of at least 25 mm between the cathodes and the protected surface for protection against local transpassive corrosion. Cathode diameter is such that significant current can be carried to the end of the cathode without significant voltage loss. The number of cathodes in each end of the exchanger, the length of the cathodes in and extending from each end and the size of the cathodes in each end are selected based on the relative current requirements in each end and the need to maintain low current densities entering the acid in both ends of the shell space. Preferably, the invention provides a single cathode at the cold end and a plurality of cathodes at the hot end. One typical arrangement is the provision of two cathodes in the hot end of the exchanger and a single cathode in the cold end. The use of two or more cathodes in the hot end provides a greater current carrying capacity for the same voltage loss down the cathode rod. An alternative feature embodies the use of longer cathodes from one end than from the other end, such as for example, a longer cold cathode than the hot cathode. For a suitable ten meter long exchanger, a cold cathode is six meters long and a hot cathode or cathodes is or are four meters long. Typically, the ends of the cathodes emanating from the hot and cold ends of the exchanger are separated, longitudinally, by about 0.25– 0.5 m.

Preferably only one diameter of cathode rod is used in the anodic protection system of the invention, although it is within the invention that dissimilar diameter sized rods may be used. Using a larger diameter rod in the zone with the higher current demand provides a larger current carrying capacity and cuts voltage losses due to current flow along the cathode rod. In this case there is a modest increase in the surface exposed by the cathode rod to the acid in the hot zone but a net increase in the current density entering the acid. With use of same diameter rods and multiple cathodes in the hot zone relative to the cold zone, only one size of cathode needs to be stocked and a more uniform current density leaving the cathode results in the exchanger. This option commonly results in a single cold end cathode and between two and four hot end cathodes and is a preferred arrangement. Where the current requirements in the hot end are very high relative to the cold end, a design incorporating an even larger number of cathodes in the hot end with smaller diameter, the number being picked to give the same metal cross-section for longitudinal current flow while significantly greater surface for current flow into the acid in the hot end is used. Such low current densities in the hot zone results in fewer side reactions as well as a lower voltage differential between the cathode and the acid. Accordingly the size of the cathode rods between the zones is varied as is holding the rods to a constant diameter.

Shell and tube acid coolers may have many different tubing layout patterns which need to be anodically protected. The shells may be completely filled with tubes, segmental baffles may be used with dome spaces on either side of the tube bundle or annular tube bundles with disc and donut baffles may be used with an empty core and outer annulus free of tubes.

In the case of the shell filled with tubes, each cathode of an arrangement in accordance with the present invention has a hole in the tubing layout large enough to cope with the largest of the insulating bushing or the pipe means through the water box of the exchanger. This hole allows acid in the shell space of the exchanger to bypass a portion of the tube bundle. A preferred location is in the outer baffle opening next to the exchanger shell where the acid flow is parallel to the tube and the cathode is accessible through the shell, either for inspection, or to accept power from the power supply. The number of holes in the tube bundle is set by the largest number of cathodes in one zone of the exchanger. It is also possible to locate the exchangers in the main body of the bundle but the holes will contribute to poorer heat transfer, the cathodes can not accept an intermediate power feed and the cathodes will need to be removed for inspection.

The case where segmental baffles are used and dome spaces are provided on either side of the bundle has been discussed hereinabove.

Where the tubing is in an annular arrangement, cathodes can be located either in the core or outer annulus of the exchanger. In the core there is adequate space for the cathodes relative to adjacent metal, the location is central to the surface being protected, and at the ends it would be possible by use of an annular water box to eliminate the need for an air to water seal and simply provide an acid to air seal. The disadvantage of the core layout is that the cathodes are not inspectable from outside and there is no longer a possibility of an intermediate current feed. The outer annulus by comparison is of quite modest width, of the same order of magnitude as the clearance needed for the insulating bushing or the pipe through the water box. On the other hand, intermediate power input is possible as is external inspection of the cathode. The uniform flow from such a cathode to the whole bundle is open to more doubt than in the case of the core cathode. In various aspects of the present invention the cold end has one or two core cathodes and the hotter end has multiple cathodes located in the outer annulus and, optionally, also one or more core cathodes.

More preferably, the cathode means comprise bare elongated cathodes.

BRIEF DESCRIPTION OF THE DRAWINGS

In order that the invention may be better understood preferred embodiments will now be described by way of example only with reference to the accompanying drawings wherein.

DETAILED DESCRIPTION OF PREFERRED EMBODIMENTS

Figure 1:
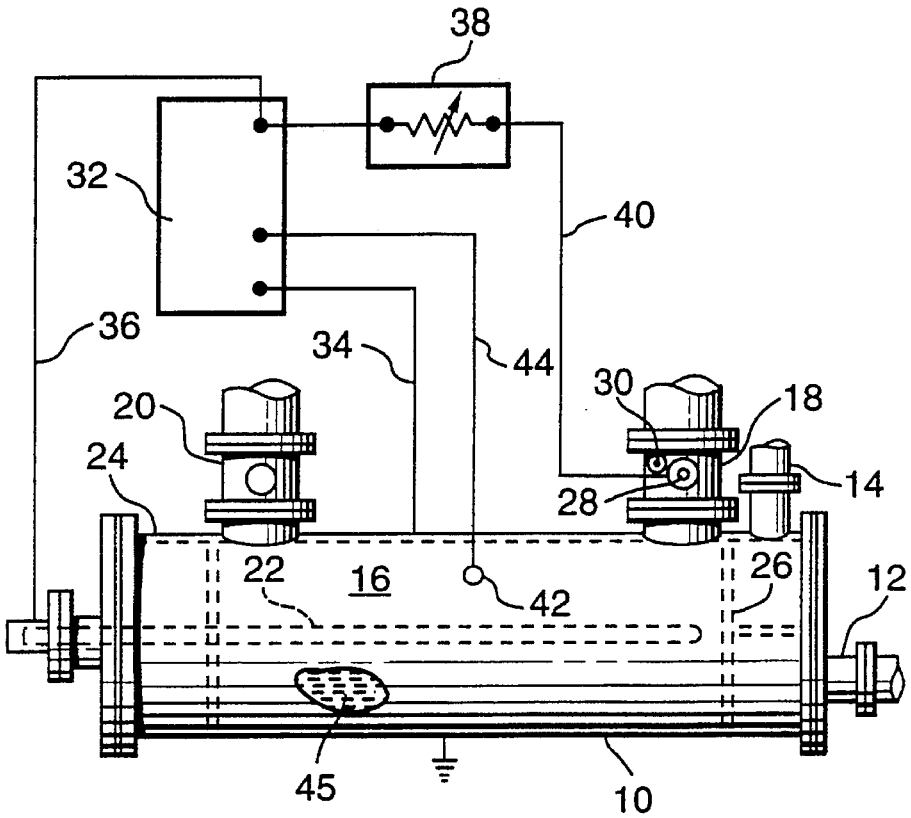
FIG.1. (PRIOR ART)
FIG. 1 is an elevational view of a prior art anodic protected heat exchanger showing the location of the electrodes and cooperating electrical circuit.

FIG. 1 shows a prior art anodic protection system of the type described in European Patent Application No. 0018124, published Oct. 29, 1980, incorporating a variable current feed to a pin cathode.

Heat exchanger, shown generally as 10, has an applied anodic protection 'system. Nozzles 12 and 14 allow water, for example, to flow through tubes of exchanger 10, cooling, for example, hot sulphuric acid contained in shell space 16. Acid enters shell space 16 of exchanger 10 through shell nozzle 18 and leaves though nozzle 20. A representative central main cathode 22 is shown as a dotted line, entering exchanger 10 through water box 24 at an end of exchanger 10 and stopping just short of tube sheet 26 at the opposite end of exchanger 10 in shell space 16. A pin or trim cathode 28 is shown in acid outlet nozzle 18, while a reference electrode 30 is present in the acid outlet piping. In this embodiment, the positive terminal of controller 32 is grounded to the surface of exchanger 10 by line 34 while the negative terminal is connected directly to central cathode 22 by line 36, and indirectly through a variable resistance 38 and line 40 to pin cathode 28. A main reference electrode 42 on the shell of exchanger 10 is connected through line 44 to controller 32. The tube bundle being protected is shown as 45.

Figure 2:
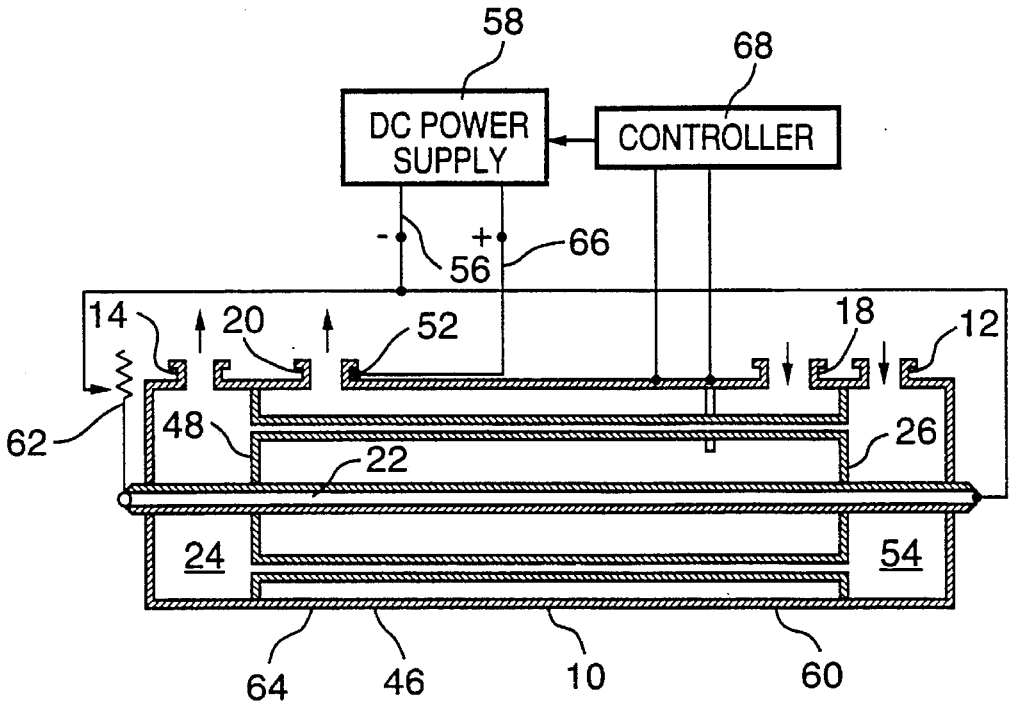
FIG.2. (PRIOR ART)
FIG. 2 is a schematic sectional view of an alternative prior art anodically protected heat exchanger.

In FIG. 2, prior art exchanger shown generally as 10 has water nozzles 12 and 14, shell space 16 and acid nozzles 18 and 20, with water flowing through the tubes and acid through shell space 16 similarly as the flow shown in FIG. 1. The shell Space 16 around the tubes is defined by the shell of exchanger 46, tube sheets 26 and 48 and the tube bundle 45 (not shown). Reference electrode 50 is mounted near acid inlet nozzle 18 and electrode 52 is mounted on the shell nozzle at the acid outlet end of shell space 16. Main cathode 22 in this embodiment penetrates both water boxes 52, 54 and the hot end of cathode 22 is connected directly to negative terminal 56 of power supply 58.

The cold end of cathode 22 which projects from water box 24 at the cold end 64 of the exchanger 10 is connected to the negative terminal 56 of the power supply 58 through a variable resistor 62. The positive terminal of power supply 58 is connected to the shell.

Controller 68, using either of reference electrodes 50 or 52 regulates the power feed to cathode 22 from power supply 58. Unlike as seen in prior art exchanger 10 shown in FIG. 1, the length of the current flow path in FIG. 2 is half that in FIG. 1 and the current flow entering the cathode at either end is only half of that of FIG. 1. Voltage losses in the cathode are therefore a quarter of those obtained in prior art FIG. 1.

Figure 3:
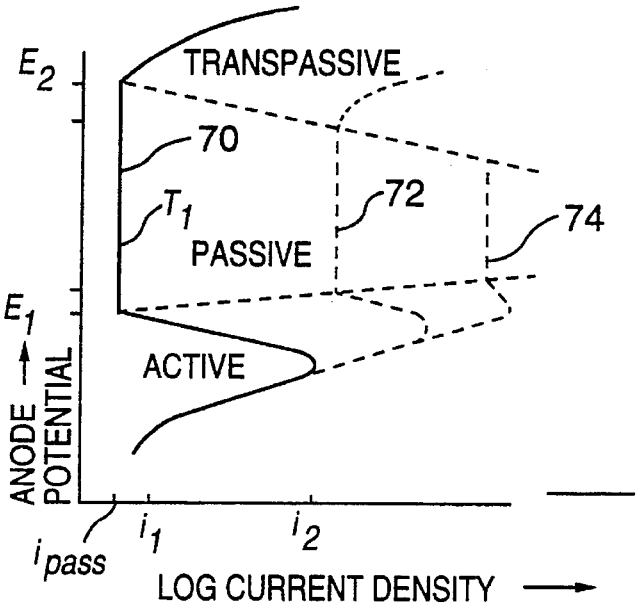
FIG. 3 is a graph showing the active, passive and transpassive ranges for anodic protection.
Figure 4:
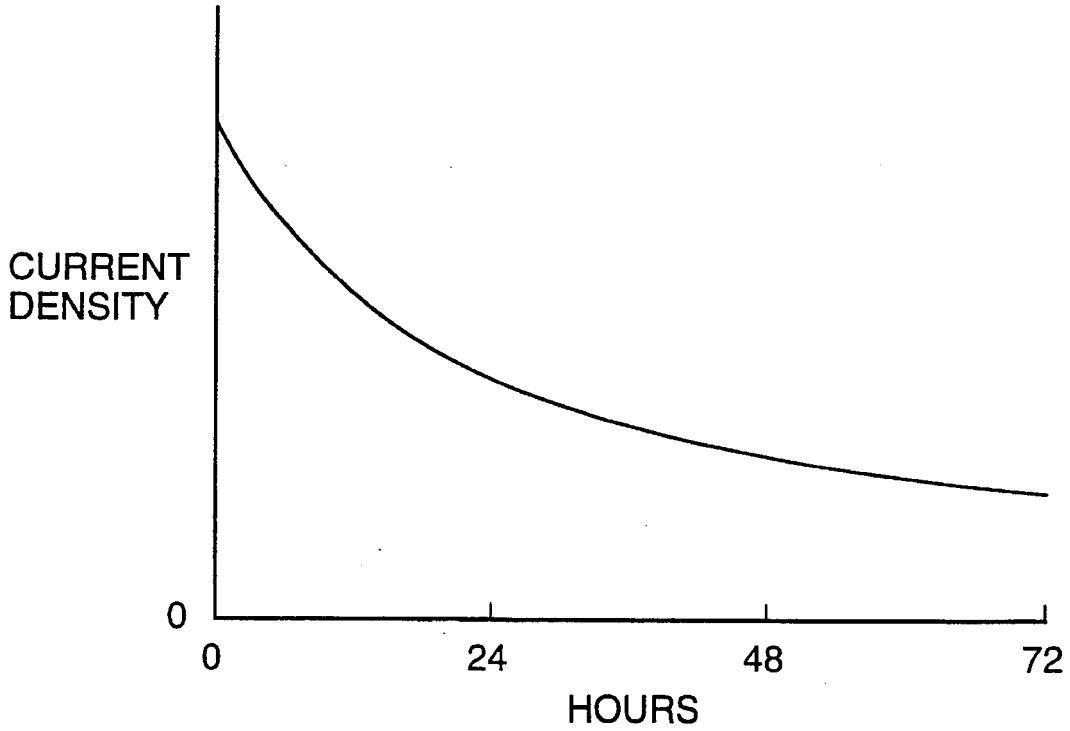
FIG. 4 is a graph showing a current versus time decay curve for a typical anodically protected heat exchanger.

FIGS. 3 and 4 are presented to provide an explanation of the basic anodic protection phenomenon.

FIG. 3 shows a series of three polarization curves for stainless steel in concentrated sulphuric acid at three different temperatures, $T_1$, $T_2$ and $T_3$. First curve 70, is typical for a cold sulphuric acid environment and shows the anodic voltage potential along the vertical axis and the current on a semi-logarithmic scale on the horizontal axis. Without a potential being applied, the corrosion rate is equal to a corrosion current $i_1$. As the anodic potential is increased, both the corrosion rate and the corrosion current increase until at $i_2$ a stable oxide film is formed. The current decreases to a much lower value i-pass, a value much lower that $i_1$ and corresponds to a corrosion rate well below 0.004 mm per year. At this point, the anodic potential value is E-1, which corresponds to the lower limit of the passive zone. A further increase in the anodic potential has no significant effect on the passivity of the surface until potential E-2 is reached, which corresponds to the upper limit on the passive zone. The passive voltage range is therefore from E-1 to E-2. Beyond anodic voltage E-2, the current increases rapidly with a partial breakdown of the passive film and significant transpassive corrosion is observed. By comparison, when the anodic potential is below the lower limit of the passive zone the corrosive is referred to as active corrosion. Curves 72 and 74 represent similar scans at higher temperatures at which higher corrosion rates would normally be expected. It can be seen from the curves that as the temperature increases from $T_1$, through $T_2$ to $T_3$, the passive current also rises, while the width of the anodic passive zone has narrowed. Over its full length, an exchanger contains material exposed to sulphuric acid at a variety of temperatures with some of the material relatively cold and some of the material relatively hot. At any cross-section of the exchanger, the passive curve limits are best set based on the hottest metal at that section of the exchanger.

The polarization curves shown in FIG. 3 are based also on varying the anodic potential at a fixed rate known as the scan rate. Typical scan rates would be 0.1 to 1 volt per hour. In actual practice, the current also varies with time, and leaving the potential fixed over an extended period normally results in a decay of the current to much lower values than the scan rate values.

FIG. 4 shows a typical decay of current from the time of initial passivation. Current can continue to decay on a heat exchanger over a period of days. The decay is interpreted to represent a successive passivation of the surfaces. The film after such exposure appears to have a significant life after the anodic potential is removed, as would happen in the case of failure of the controller or power supply.

Figure 5:
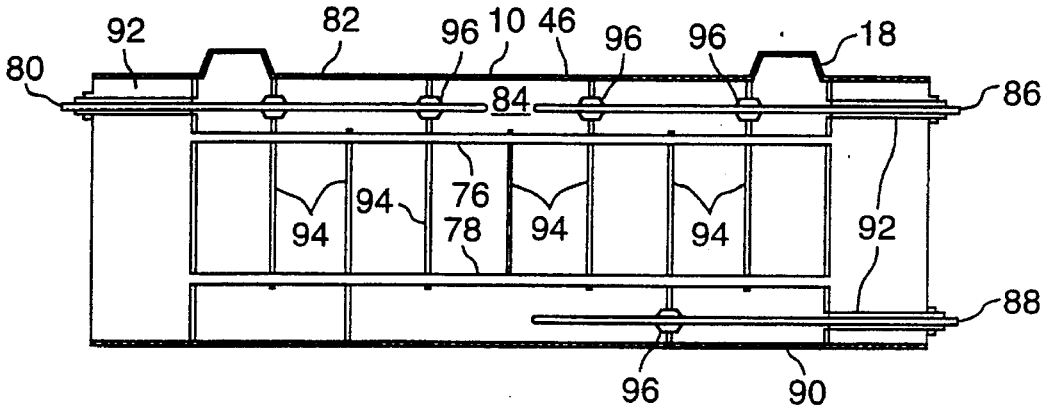
FIG. 5 is a schematic sectional view of a heat exchanger having an improved anodic protection system according to the invention.

FIG. 5 shows generally as 10, an exchanger having a shell 46 containing a tube bundle limited by tubes 76 and 78, as shown. Exchanger 10 contains a cathode 80 extending from the left end 82 of exchanger 10 as shown, to approximately the middle of exchanger 10. Cathode 80 is disposed in dome space 84 below the tubes. Two cathodes, 86 and 88 of similar size are disposed above and below, respectively, the tube bundle from the right end 90 of exchanger 10 as shown, parallel to the tubes and extend almost to the middle of exchanger 10.

All cathodes 80, 86, and 88 in this embodiment of the invention are insulated from the metal surfaces being protected by suitable corrosion resistant tubing such as PTFE (polytetrafluoroethylene) in the water box pipes 92 and in the baffles by insulating bushings 96 of similar or the same plastic non-conductive materials. In this embodiment, hot sulphuric acid enters exchanger 10 through a nozzle 18 in the zone where cathodes 86 and 88 are located where the current demand is highest. A modest gap between the ends of cathodes 80 and 86 is of the order of one baffle spacing, or less, typically 25 to 50 cm.

It will be readily appreciated that the relative numbers of cathodes and values of cathode diameters and cathode lengths may be varied depending on the foreseen current requirements in the two ends of the shell and the desired current densities entering the acid from the cathodes.

Figure 6:
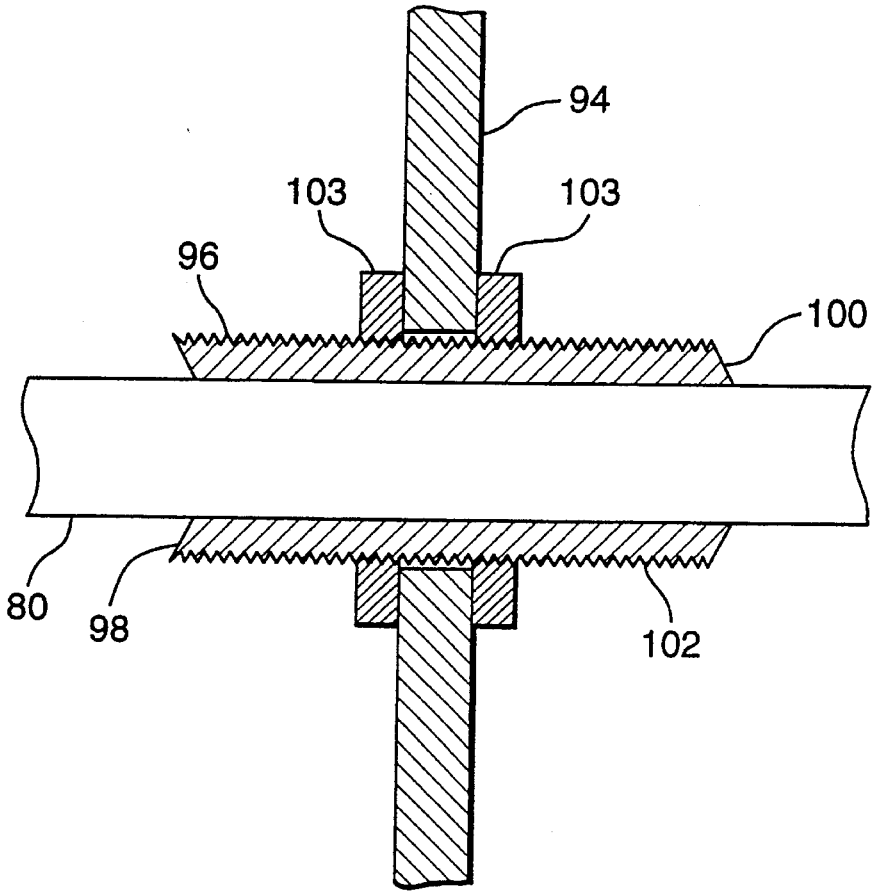
FIG. 6 is a schematic sectional view, in part, showing an insulating bushing.

FIG. 6 shows an embodiment of an insulating bushing suitable for use in a baffle 94 of use in the invention. Cathode 80 is partly embraced by a cylinder of glass-filled polytetrafluoroethylene bushing 96. Bushing 96 is relatively dimensionally stable and has a concave cone 98 and a projecting convex cone 100. Concave cone 98 faces the cathode entrance and facilitates insertion of cathode 80 during assembly, while convex cone 100 can remove deposits on the surface of cathode 80, if any, when cathode 80 is pulled back for removal or inspection. Bushing 96 has an external thread 102 which receives retaining nuts, 103. Significant clearance is needed between cathode 80 and bushing 96 and a typical value would range from 3 to 7 mm. Many variations are possible for securing such an insulating bushing 96 to baffle 94 and any suitable insulating material can be used, including ceramics as well as plastics.

Figure 7:
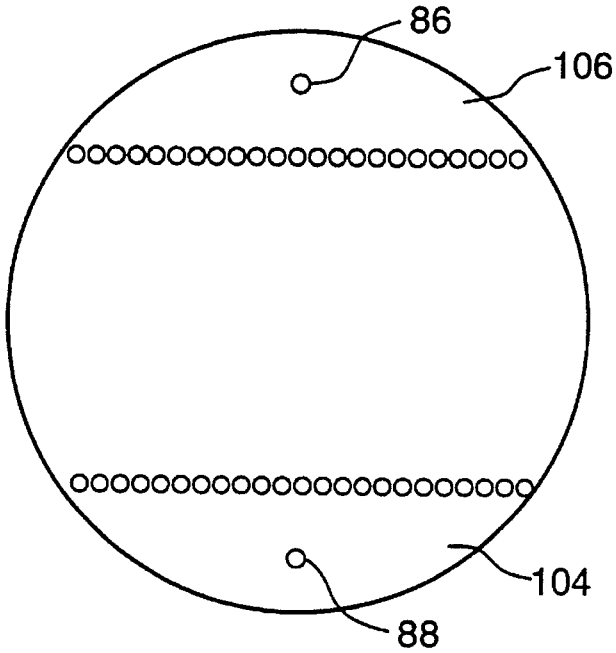
FIG. 7 is a schematic cross-sectional view of the locations of the hot end cathodes of a heat exchanger according to the invention.
Figure 8:
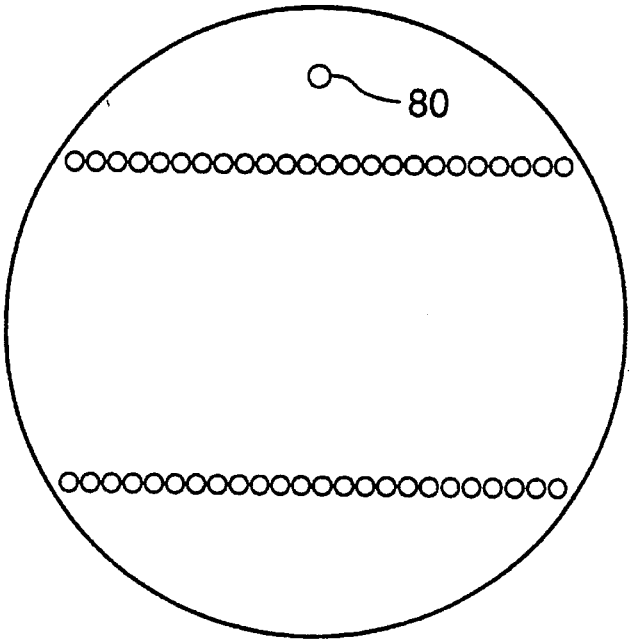
FIG. 8 is a schematic cross-sectional view of the location of the cold end cathode of a heat exchanger according to the invention.

FIGS. 7 and 8 show cathodes 80, 86 and 88 locations in dome spaces 102 and 104, respectively, in the cold and hot ends, respectively, of exchanger 10. Dome spaces 104 contain cold cathode 80, and hot cathode 86 while dome space 102 contains hot cathode 88. Since cathodes 80, 86 and 88 are in dome spaces 102 and 104, adjacent to the shell and are bare between insulating bushings 96 in baffles 94, provision of power to the longitudinal section to the elongated cathodes through the shell is now feasible.

Figure 9:
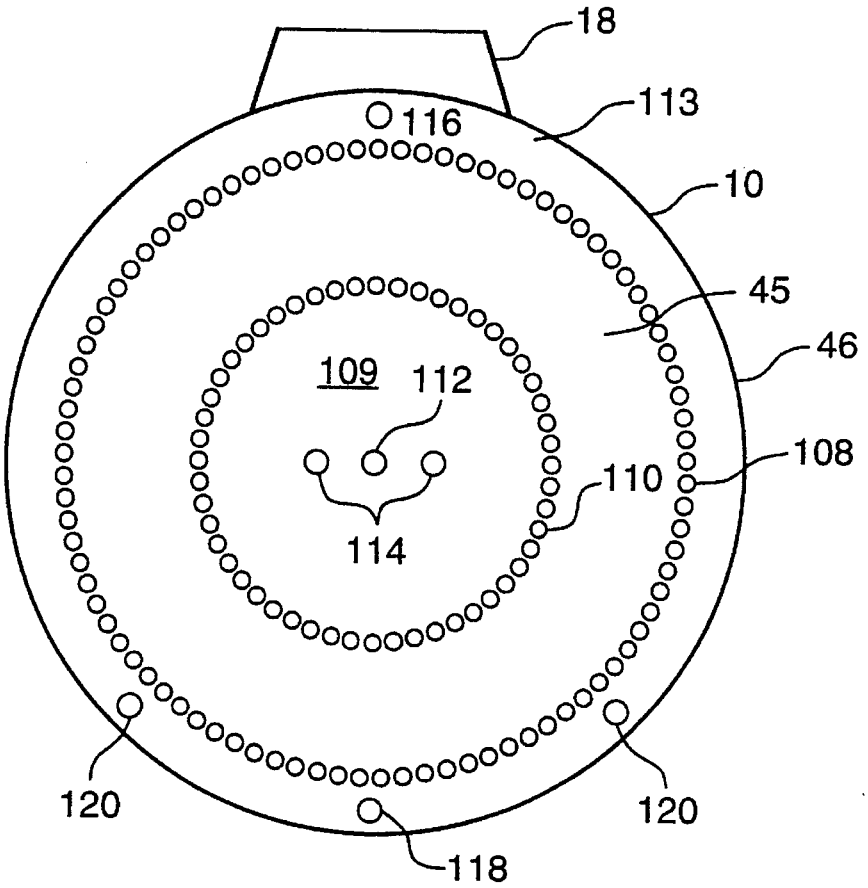
FIG. 9 is a schematic cross-sectional view of an exchanger with tubes laid out in an annular ring showing the possible location of cathodes according to the invention.

FIG. 9 shows possible cathode positions for the case where the invention is used with an annular tube bundle. Here FIG. 9 shows an end view of exchanger 10 within shell 46 and showing an acid nozzle 18. Tube bundle 45 is defined by an outer circle of tubes 106 and an inner circle of tubes 108. Where cathodes are located in the central tube free space 109, a central location 110 is appropriate for a single cathode. For two cathodes, positions straddling the centre line of exchanger 112 are suggested. Similar triangular patterns are not shown but within the present invention. Where the current demand in the unit is high and it is desired to use power feed through the shell, cathodes may be placed in outer annular space 111. For two cathodes, the preferred locations are central to nozzle 114 and opposed 116, so that the cathodes impede acid flow around the bundle the least possible.

Where three cathodes are used, a cathode central to nozzle 114 and cathodes at 120° to the central cathode at positions shown as 118 is offered. A spacing of 90° is preferred for four cathodes in the outer annulus. Combinations of central cathodes and cathodes in the outer annular ring are viable alternatives but not shown.

Figure 10:
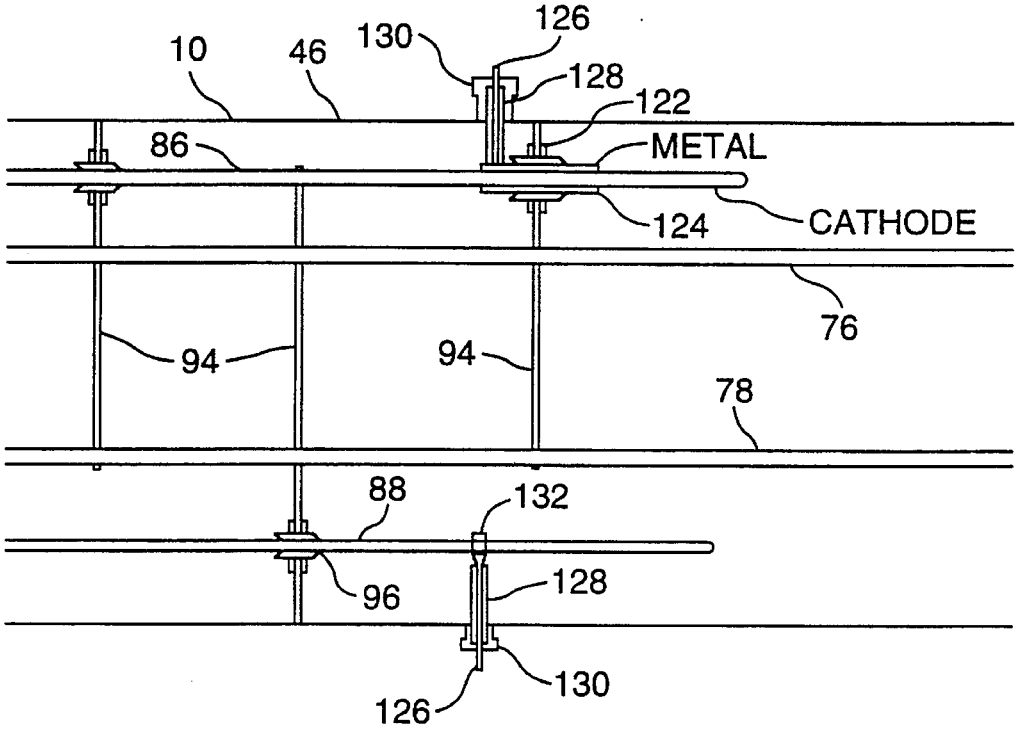
FIG. 10 is a schematic view showing power supply to cathodes in the shell space at a baffle and between baffles according to the invention.

FIG. 10 shows a baffle bushing adapted to provide power to such a longitudinal cathode and shows a power connection away from baffles. In this embodiment, baffle bushing 122 is adapted to provide a contact between a cathode 86 and an external power source (not shown). For power connection at baffle 94, bushing 122 has a metal sleeve 124 next to cathode 86 and the sleeve is connected by a wire 126 with an insulating sleeve 128 and a sealing gland 130. For power feed to cathode 88 beyond bushing 96 a suitable clamp 132 is attached through an insulating sleeve 128 to cathode 88 and projects outside exchanger shell 46 and acid to air seal 130 to connect to the power supply (not shown).

Figure 11:
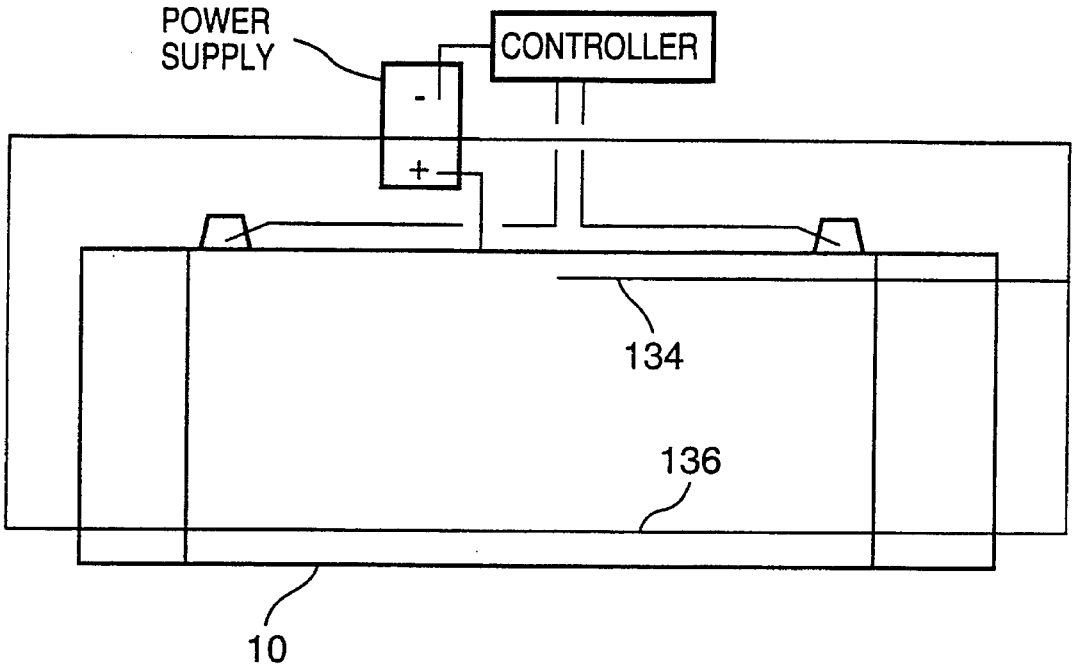
FIG. 11 is a schematic view of an exchanger showing the end power supply to two hot end and one cold end cathodes according to the invention.

FIG. 11 shows diagrammatically a hot end cathode constituted as cathode 134 and part of cathode 136 which extends through the full length of exchanger 10 and thus constitutes the cold end cathode as well.

Figure 12:
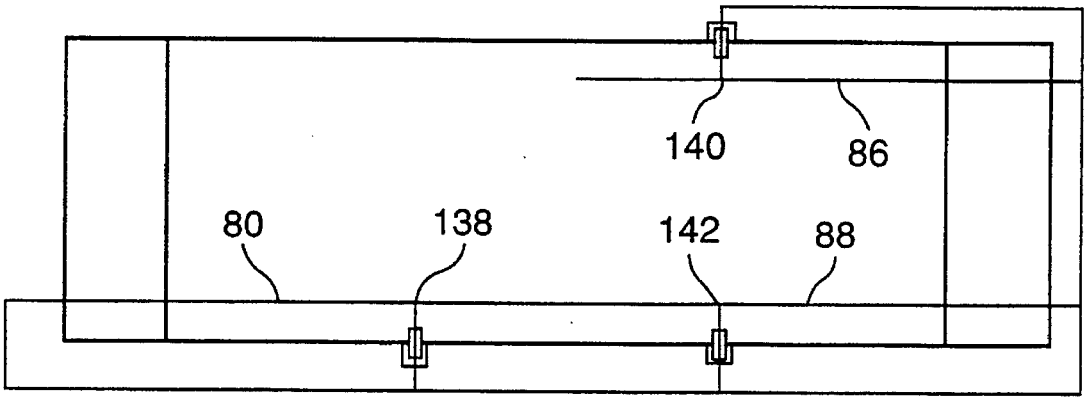
FIG. 12 is a schematic view of an exchanger showing end and shell power feeds to hot and cold end cathodes according to the invention.

FIG. 12 shows an arrangement where power is fed to a single half length cathode rod at the cold end of the exchanger and to two half length cathode rods at the hot end of the exchanger. Current is introduced to the cathode rods at their outer ends. Current is also introduced through the exchange shell to the three cathodes 80, 86, and 88, respectively, through the shell at points approximately two thirds of the distance from the outer ends to the centre of the exchanger, 138, 140, and 142. In this embodiment the distance which the current must flow along a cathode rod is reduced to one sixth of the length of the rod and the current flowing at any point is reduced by a similar factor of six. The voltage losses for flow along the cathode are a function of the length of the cathode and the current.

In practice, the location of the actual current feed points will depend on the baffle layout and the desired profile of current entering the acid and, thus, the two-thirds points will move.

FIG. 13*a* to 13*f* illustrate voltage losses along cathode rods for a variety of embodiments ranging from current feed from one end to the current feed at both ends, as seen in the prior art, and to present embodiments having separate cathode means and feed both from the ends and from ends and through the shell of the exchanger.

The following calculations are theoretical for an exchanger using 16 mm diameter Hastalloy B-2 cathodes with a thirty foot tube length. Current flow for the calculation was taken as 20 amperes.

Figure 13:
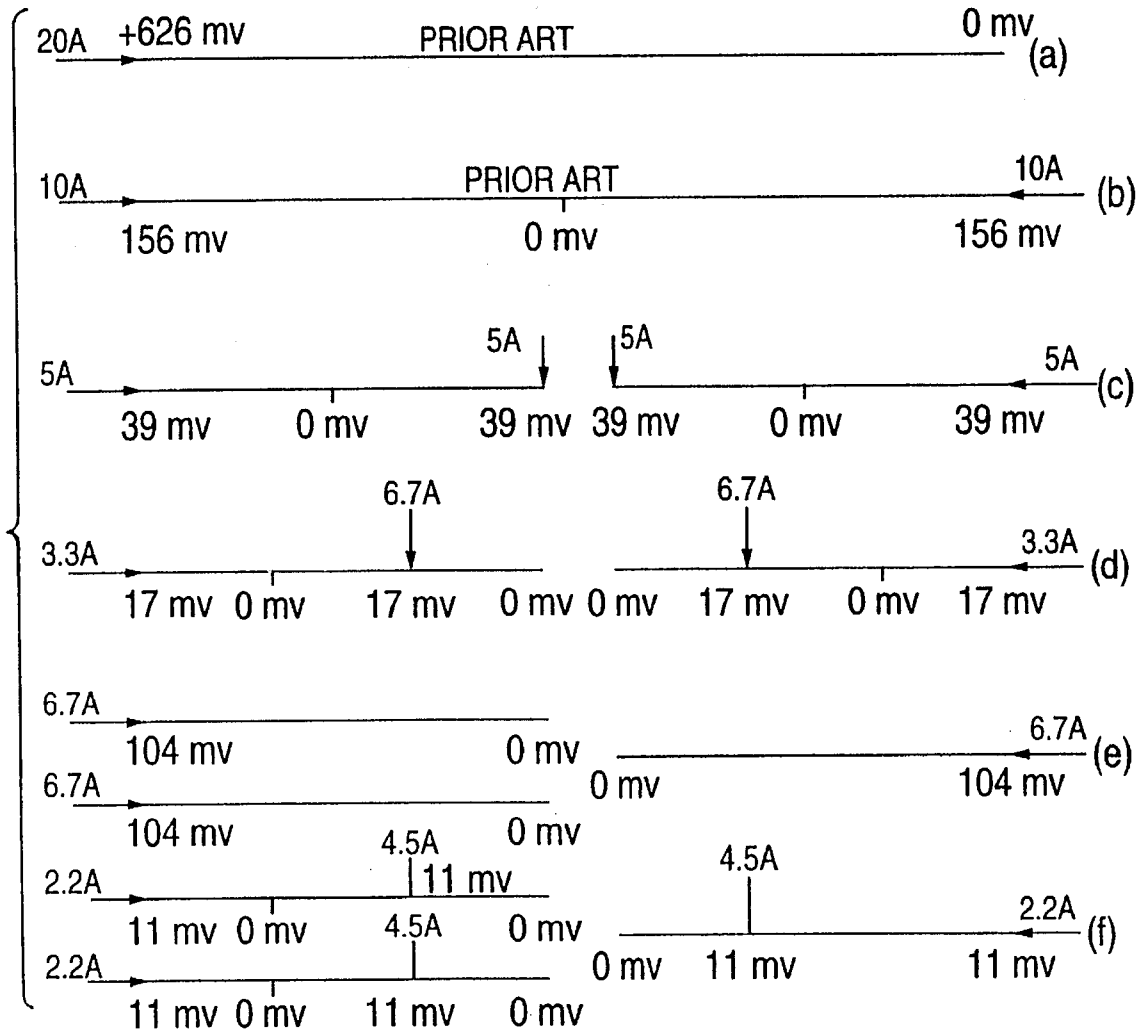
FIGS. 13*a* to 13*f* are diagrams showing voltage losses for a variety of power feeds to anodically protected prior art and invention heat exchangers; and wherein the same numerals denote like parts throughout the drawings.

FIG. 13*a* is an embodiment of the prior art and represents a base case for comparison. Here a cathode current enters the cathode from one end, usually the hot end of the exchanger, and flows down the cathode rod to the opposite end, leaking continuously into the acid. Based on a uniform leakage of current into the acid per unit length of cathode, approximately 630 mv is required at the power inlet to ensure that the appropriate current flow can be achieved. By comparison, the width of the passive zone is, typically, not much larger than 300 mv. The exchanger is therefore likely to have either transpassive conditions at the power inlet or inadequate protection at the opposite end. Pin or trim cathodes can add current at the far end of the cathode but the current from the pin cathode is only effective locally in the exchanger and does not eliminate the problem.

FIG. 13*b* shows the effect of connecting both ends of the cathode to the power supply as shown in Sanz (U.S. Pat. No. 4,588,022). Here the current need only flow half the length of the cathode and the current flow at either end is half of the previous value if uniform conditions are assumed. A first trial value of voltage loss would therefore indicate one quarter of the value in embodiment FIG. 13*a* or 156 mv, which is lower in value than the passive zone width but does not meet the target of losses an order of magnitude smaller than the zone width. Two ended feed is now in practical use and has proven significantly superior to the one ended feed case as shown in FIG. 13*a*.

Embodiment shown in FIG. 13*c* shows separate cathode rods in the two ends of the exchanger with current feeds to the outer and inner ends of the two cathodes. Here the current is split into four streams and the length of current flow is cut to one quarter of the tube length, reducing the voltage losses to 40 mv, within the range of the target voltage loss. A similar result would be achieved with a single cathode with a central power feed and end feeds.

Embodiment of FIG. 13*d* is very similar to that of FIG. 13*c*, but in this case the power feeds through the shell allow connections to the cathodes in the shell space two-thirds of the distance from the outer ends to the inner ends. Current then flows from these intermediate feed points in two directions, instead of one and current flow is then split into six streams instead of four as for case FIG. 13*c*.

The distance current has to flow is also reduced to one-sixth of the tube length. The calculated loss now decreases to under 20 mv which is more than on order of magnitude lower than the passive zone width. For this case, smaller cathode rods could be used with a cost saving.

FIG. 13*e* illustrates an embodiment of the invention where notice is taken of the different current demands in the two ends of the exchanger. In this case, one cold end and two hot end cathodes are used. This embodiment is for the situation where power feeds to the cathodes through the shell are not practical, such as when an annular tube bundle is used and the cathodes are in the core opening. With the same size cathodes, slightly over 100 mv would be needed, suggesting that more or larger cathodes be used. While this upgrading would add to the cost of the cathodes it would be much more than offset by the more efficient exchanger design. Cathode diameters of 32 mm are also available, which would give voltage losses of 26 mv, and thus within the desired performance range.

FIG. 13*f* embodies the use of different cathode means as well as intermediate power feed through the exchanger shell as illustrated in this invention and offers the lowest loss in potential of any of the embodiments shown. Here account has been taken of the higher current demand of the hot end of the exchanger by the provision of two hot end cathodes. Calculated voltage losses have decreased to 11 mv, suggesting either that the system can handle much more current or smaller cathodes.

Thus, with reference to FIGS. 13*a* to 13*f*, it is clear that there is a massive advantage to feeding power to the cathodes through the shell as well as through the ends. It is also clear that there is an advantage in terms of voltage loss in a relative increase in cathode use in the hot end of the exchanger relative to the cold end. It is also clear that much lower voltage losses can be obtained without significant increase in cathode material. The placing of cathodes in the dome spaces in the shell, the optional use of bare cathodes, the use of part length cathodes, and the provision of more cathode in the hot ends thus satisfies most of the objects set out for the improved cathode system of the invention.

A further feature of the invention is that the system in all of its embodiments offers four separate power feed points along the shell space with the possibility that the same voltage need not be fed to all four points and that a voltage profile along the cathode can be established which can offer optimal protection to the surface in the shell space from one end to the other.

The concept of use of variable resistances shown in previous patents is one method by which different voltages can be delivered to the various cathodes but also the power supply could be modified to achieve the same result.

A further advantage of the instant invention is that the division of the exchanger into first and second zones allows the start-up of the anodic protection system to proceed by zones with all of the power diverted to the hot zone on start-up and only bring diverted to the cold zone when the current demand for passivation in the hot zone has started to decay.

Although this disclosure has described and illustrated certain embodiments of the invention, it is to be understood that the invention is not restricted to those particular embodiments. Rather, the invention includes all embodiments which are functional or mechanical equivalents of the specific embodiments and features that have been described and illustrated.

I claim:

1. In a heat exchanger for a corrosive fluid, said heat exchanger having an elongated shell, said shell having dome spaces, a first end shell inner surface defining a first end shell space and a second end shell inner surface defining a second end shell space, a plurality of elongated tubes extending longitudinally within said shell, said corrosive fluid being located between said shell and the exterior surfaces of said tubes and a heat exchange fluid flowing within said tubes to exchange heat with said corrosive fluid, baffle means within said shell for directing the flow of said corrosive fluid in a tortuous path within said shell; an anodic protection system for protecting the exterior surfaces of said tubes, said anodic protection system comprising: power supply means for supplying a positive potential, means for connecting said positive potential to said shell, elongated cathode means extending longitudinally in said shell and insulated from said shell and tubes, said cathode means being of a material having substantial electrical resistance, connection means to said cathode means, wherein the improvement comprises said cathode means having a first, elongated cathode means in a first dome space and associated with said first end shell space and a distinct, second, elongated cathode means in a second dome space and associated with said second end shell space, said first and said second cathode means being of such cross-sectional area and length as to operably maintain voltage losses due to current flow along said first and said second cathode means at values less than the allowable passive voltage ranges at each of said inner surfaces of said first and said second shell spaces, said first cathode means being of greater cumulative cross-sectional area than a cumulative cross-sectional area of said second cathode means.

2. A heat exchanger as claimed in claim 1 wherein said first cathode means comprises a plurality of first cathodes.

3. A heat exchanger as claimed in claim 1 wherein said second cathode means comprises a single second cathode.

4. A heat exchanger as claimed in claim 1 wherein said first cathode means is of such size relative to said second cathode means as operably to allow of current densities leaving said first cathode means and said second cathode means to be of substantially the same order of magnitude.

5. A heat exchanger as claimed in claim 1 wherein said first cathode means is of such size relative to said second cathode means as to operably allow of current densities leaving said first cathode means and said second cathode means to be substantially the same.

6. A heat exchanger as claimed in claim 1 wherein said cathode means are disposed in whole or in part in said dome spaces.

7. A heat exchanger as claimed in claim 1 wherein said first end shell space constitutes substantially a first half of said exchanger, and said second end shell space constitutes substantially the second half of said exchanger.

8. A heat exchanger as claimed in claim 1 wherein said cathode means are disposed in whole or in part in the core of a disc-and-donut heat exchanger.

9. A heat exchanger as claimed in claim 1 wherein said connection means are located on the outer ends of said cathode means.

10. A heat exchanger as claimed in claim 1 wherein said connection means include radial connections through the shell to cathode means located in the shell spaces of said exchanger.

11. A heat exchanger as claimed in claim 1 wherein 'said cathode means are bare.

12. A heat exchanger as claimed in claim 1 wherein said first and second cathode means comprise individual cathodes of the same diameter.

13. A heat exchanger as claimed in claim 1 wherein said cathode means is adapted to provide in each shell space a similar and low current density where the current operably flows from said cathode means into said acid.

14. A method of anodically protecting a heat exchanger for a corrosive fluid, said heat exchanger having an elongated shell, a first end, a second end, a first tube sheet at said first end and a second tube sheet at said second end, said shell having dome spaces, a first end shell inner surface defining a first end shell space and a second end shell inner surface defining a second end shell space, a plurality of elongated tubes extending longitudinally within said shell, said corrosive fluid being located between said shell and the exterior surfaces of said tubes and a heat exchange fluid flowing within said tubes to exchange heat with said corrosive fluid, baffle means within said shell to direct the flow of said corrosive fluid in a tortuous path within said shell; an anodic protection system for protecting the exterior surfaces of said tubes, said anodic protection system comprising: power supply means for supplying a positive potential, means for connecting said positive potential to said shell, elongated cathode means extending longitudinally in said shell and insulated from said shell and tubes, said cathode means being of a material having substantial electrical resistance, connection means to said cathode means, wherein said cathode means has a first elongated cathode means associated with said first end shell space and a distinct, second elongated cathode means associated with said second end shell space, said first and said second cathode means being of such cross-sectional area and length as to operably maintain voltage losses due to current flow along said first and said second cathode means at values less than the allowable passive voltage ranges at each of said inner surfaces of said first and said second shell spaces, said method comprising:

maintaining voltage losses due to current flow along said first and said second cathode means at values less than the allowable passive voltage ranges at each of said inner surfaces of said first and said second shell spaces.

15. A method as claimed in claim 14 in which said shell spaces have separate power feeds to each space such that the voltages generated in each space produces passive conditions on the surfaces being protected while the voltage losses along the cathode means are smaller than the range of safe passive voltages in either end of said exchanger.

16. A method as claimed in claim 14 in which cathode voltage losses are an order of magnitude less than the passive voltage range.

17. A method as claimed in claim 14 in which power is fed to cathode ends as well as through said shell and individual voltages at the feed points are regulated to provide optimum protection.

18. A method as claimed in claim 14 in which power is supplied to said cathode means only through said shell of said exchanger between said first and said second tube sheets.

19. A method as claimed in claim 14 in which on startup, power is supplied initially to only one of said end shell spaces.

* * * * *